United States Patent [19]

Suzuki et al.

[11] Patent Number: 4,461,818

[45] Date of Patent: Jul. 24, 1984

[54] METHOD FOR MAKING PRINTING PLATES EMPLOYING AN ORGANIC PHOTO-CONDUCTIVE COMPOUND AND A STYRENE-MALEIC ANHYDRIDE HALF ESTER AS A BINDER

[75] Inventors: Shigeyoshi Suzuki; Koji Uchida; Jun Yamada; Takao Senga, all of Nagaokakyo, Japan

[73] Assignee: Mitsubishi Paper Mills Ltd., Tokyo, Japan

[21] Appl. No.: 423,301

[22] Filed: Sep. 24, 1982

[30] Foreign Application Priority Data

Oct. 31, 1981 [JP] Japan ..... 56-175049

[51] Int. Cl.[3] ..... G03G 13/26

[52] U.S. Cl. ..... 430/49; 430/306; 430/310

[58] Field of Search ..... 430/49, 306, 627, 310

[56] References Cited

U.S. PATENT DOCUMENTS 3,315,602 4/1967 Clark et al. ..... 430/49

4,287,293 9/1981 Iwata et al. ..... 430/627

*Primary Examiner*—John E. Kittle

*Assistant Examiner*—John L. Goodrow

*Attorney, Agent, or Firm*—Cushman, Darby & Cushman

[57] ABSTRACT

Disclosed is a method for making a printing plate which comprises forming a toner image by electrophotography on a master plate which comprises a base and an organic photo-conductive compound-containing layer, the binder for said organic photo-conductive compound being a half ester resin of a styrene-maleic anhydride copolymer and then subjecting non-image areas other than the toner image areas to an etching treatment with a solution mainly composed of an alkali and/or an alcohol. Thus obtained printing plate is excellent in printing endurance and, besides, can be rapidly etched.

7 Claims, No Drawings

METHOD FOR MAKING PRINTING PLATES EMPLOYING AN ORGANIC PHOTO-CONDUCTIVE COMPOUND AND A STYRENE-MALEIC ANHYDRIDE HALF ESTER AS A BINDER

BACKGROUND OF THE INVENTION

This invention relates to a method for making a printing plate, which comprises electrophotographically forming a toner image by using an organic photoconductive compound and subjecting non-image areas other than the toner image areas to an etching treatment with a solution containing an alkali and/or an alcohol as major component.

Various printing plates employing organic photoconductive compounds have been known. As examples, mention may be made of those disclosed by Japanese Patent Publication Nos. 17,162/62, 6,961/63, 2,426/66, and 39,405/71; Japanese Patent Application "Kokai" (Laid-open) Nos. 19,509/75, 19,510/75, 145,538/79, 89,801/79, 134,632/79, 19,803/79, and 105,244/80. The binders used in these printing plates include styrene-maleic anhydride copolymers, maleic ester resins, vinyl acetate-crotonic acid copolymers, vinyl acetate-maleic anhydride copolymers, and phenolic resins.

The printing plates employing these conventional resins as the binder for a photoconductive compound, however, exhibit various disadvantages, especially when a high printing endurance is required. If a styrene-maleic anhydride copolymer is used as the binder, the coating film which is formed is hard and subject to cracking when the printing plate is bent. This seems to be caused by the relatively rigid and crystalline nature of the polymer molecule, as is evidenced by the low peel resistance in the tape test for adhesion measurement as described later. Although it is proposed to incorporate a plasticizer to improve properties of the resin, yet the plasticizer tends to deteriorate the electrostatic characteristics. If a high-boiling oil is used as the plasticizer, it is apt to migrate to the surface, thus decreasing the storage stability. The use of phenolic resins as binders presents problems on physical properties of the printing plate, similarly to the styrene-maleic anhydride copolymer. Phenolic resins are generally low in molecular weight and solution viscosity. Moreover, they form brittle films. A vinyl acetate-crotonic acid copolymer or a vinyl acetate-maleic anhydride copolymer may be called a fairly suitable binder for use in the printing plate. However, it has a disadvantage of causing the blinding of details of an image, if the number of copies reaches several tens of thousands. When an acrylic resin, a homopolymer of acrylic or methacrylic esters, is used as the binder, although an image can be formed by electrophotography, yet the etching treatment with an aqueous alkaline or alcoholic solution is not so easy, thus making it difficult to achieve the object of this invention. A maleic acid resin formed by the reaction of rosin and maleic anhydride is generally of low molecular weight; an ester of this resin is also unsuitable for the printing plate aimed at in this invention.

As a result of an extensive study to overcome the above difficulties of conventional binders, it was found that the object of this invention can be achieved by using as the binder a half-ester resin of a styrene-maleic anhydride copolymer.

SUMMARY OF THE INVENTION

An object of this invention is to provide a printing plate having a tough coating film.

Another object of this invention is to provide a printing plate of high printing endurance.

A further object of this invention is to provide a printing plate readily subject to etching treatment.

According to this invention, by using a half-ester resin of a styrene-maleic anhydride copolymer as the binder in preparing the master plate to form a tough coating film with improved adhesion to the support, there is produced a printing plate of such high printing endurance that no disturbance is observed in the image after several tens of thousands copies have been obtained. Furthermore, as compared with a styrene-maleic anhydride resin, the resin used in the present printing master reacts more rapidly when the non-image areas other than the toner image areas are treated with an etching solution (described later), thus permitting rapid processing.

DESCRIPTION OF THE INVENTION

The half ester of a styrene-maleic anhydride copolymer used in this invention can be easily obtained, as known well to the art, by boiling a styrene-maleic anhydride resin in an alcohol. It is also possible to obtain a half-ester resin by copolymerizing styrene with a monomeric maleic acid half ester prepared by boiling maleic anhydride and an alcohol.

Examples of alcohols suitable for use in preparing a half ester from a styrene-maleic anhydride copolymer or in preparing a monomeric half ester of maleic anhydride include aliphatic and aromatic alcohols such as methanol, ethanol, n-propanol, isopropanol, n-butanol, sec-butanol, tert-butanol, hexyl alcohol, methylisobutylcarbinol, 2-ethylhexyl alcohol, n-octyl alcohol, lauryl alcohol, stearyl alcohol, benzyl alcohol, phenylethyl alcohol, oleyl alcohol, and cyclohexanol. Further, alcohols having a carboxyl group, namely, hydroxycarboxylic acids, such as, for example, glycolic acid, lactic acid, $\beta$-hydroxypropionic acid, and $\beta$-hydroxybutyric acid are also useful. Especially preferred alcohols are those of 2 to 12 carbon atoms.

Examples of typical resins for use in this invention are as shown below.

(1) Styrene-monooctyl maleate copolymer (molar ratio: 60/40)

(2) Styrene-mono-tert-butyl maleate copolymer (molar ratio: 70/30)

(3) Sytrene-monoethyl maleate copolymer (molar ratio: 60/40)

(4) Styrene-monolauryl maleate copolymer (molar ratio: 50/50)

(5) Styrene-maleic acid mono(methylisobutylcarbinol) ester copolymer (molar ratio: 60/40)

(6) Styrene-mono-sec-butyl maleate copolymer (molar ratio: 70/30)

(7) Styrene-monoisopropyl maleate copolymer (molar ratio: 60/40)

(8) Styrene-maleic acid monoglycolic acid ester copolymer (molar ratio: 80/20)

(Reference 1) Styrene-maleic anhydride copolymer (molar ratio: 50/50)

(Reference 2) Styrene-maleic anhydride copolymer (molar ratio: 60/40)

(9) A half sec-butyl ester of Reference 1 (esterification degree: 60%)

(10) A half octyl ester of Reference 1 (esterification degree: 55%)

(11) A half n-butyl ester of Reference 2 (esterification degree: 65%)

(12) A half methylisobutylcarbinol ester of Reference 2 (esterification degree: 70%)

The esterification degree referred to above is the mole-% of esterified maleic anhydride component based on the total maleic anhydride component of a styrene-maleic anhydride copolymer. The half ester resins used in this invention include complete half esters and partial half esters of maleic anhydride.

The molecular weight of the resin can be in the range of from 1,000 to 500,000, but preferably in the range of from 8,000 to 150,000 in view of the strength of the coating film which is formed and the speed of etching.

The resin used in this invention may be combined with other resins, but is preferably used in an amount of more than about 50% by weight.

As examples of organic photoconductive compounds for use in the present printing master, mention may be made of the following:

(a) Aromatic tertiary amino compounds: triphenylamine, diphenylbenzylamine, di-(β-naphthyl)benzylamine, and diphenylcyclohexylamine.

(b) Aromatic tertiary diamino compounds: N,N,N',N'-tetrabenzyl-p-phenylenediamine, N,N,N',N'-tetrabenzylbenzidine, 1,1'-bis(4-N,N-dibenzylaminophenyl)ethane, 2,2-bis(4-N,N-dibenzylaminophenyl)-butane, bis[(4-N,N-di-(p-chlorobenzylaminophenyl)]methane, 3,3-diphenylallyldine-4,4'-bis(N,N-diethyl-m-toluidine), and 4,4'-bis(di-p-tolylamino)-1,1,1-triphenylethane.

(c) Aromatic tertiary triamino compounds: 4,4',4''-tris(-diethylaminophenyl)methane and 4-dimethylamino-4,4'-bis(diethylamino)-2,2''-dimethyltriphenylmethane.

(d) Condensation products: condensation product of an aldehyde and an aromatic amine, reaction product of an aromatic tertiary amine and an aromatic halogeno compound, poly-p-phenylene-1,3,4-oxadiazole, and reaction product of formaldehyde and a condensed polycyclic compound.

(e) Metal-containing compounds: 2-mercaptobenzothiazole zinc salt, 2-mercaptobenzoxazole lead salt, 2-mercapto-6-methoxybenzimidazole lead salt, S-hydroxyquinoline aluminum salt, and 2-hydroxy-4-methylazobenzene copper salt.

(f) Polyvinylcarbazole compounds: polyvinylcarbazole, halogen-substituted polyvinylcarbazole, vinylcarbazole-styrene copolymers, and vinylanthracene-vinylcarbazole copolymers.

(g) Heterocyclic compounds: 1,3,5-triphenylpyrazoline, 1-phenyl-3-(p-dimethylaminostyryl)-5-(p-dimethylaminophenyl)pyrazoline, 1,5-diphenyl-3-styrylpyrazoline, 1,3-diphenyl-5-styrylpyrazoline, 1,3-diphenyl-5-(p-dimethylaminophenyl)pyrazoline, 3-(4'-dimethylaminophenyl)-5,6-di-(4''-methoxyphenyl)-1,2,4-triazine, 3-(4'-dimethylaminophenyl)-5,6-dipyridyl-1,2,4-triazine, 2-phenyl-4-(4'-dimethylaminophenyl)quinazoline, 6-hydroxy-2,3-di-(p-methoxyphenyl)benzofuran, and 2,5-bis[4-ethylaminophenyl-(1')]-1,3,4-oxadiazole.

Further, a desirable printing plate is obtained also by using as the organic photoconductive substance such pigments as phthalocyanine pigments, quinacridone pigments, indigo pigments, cyanine pigments, perylene pigments, bisbenzimidazole pigments, quinone pigments and azo pigments.

The base material of the present printing plate may be any of those conventionally used in the printing plate. Examples are sheet metals such as aluminum sheet, zinc sheet, magnesium sheet and copper sheet; films and synthetic papers of polyesters, cellulose acetate, polystyrene, polycarbonate, polyamides, and polypropylene; and converted papers such as resin coated paper. After formation of an image, the printing master is removed of the photoconductive compound and the binder by etching treatment. Since the non-image areas thus treated is required to be hydrophilic, a base material having a hydrophobic surface should have been rendered hydrophilic by pretreatment. Sheet metals, particularly preferably aluminum sheet are preferably subjected to surface treatment such as graining, alkali treatment, acid treatment, anodic oxidation, or the like. Films are preferably coated with a polymer having a comparatively high hydrophilicity and then subjected to crosslinking treatment, or covered with a metal by vacuum evaporation or by cladding. An insulating base is preferably rendered conductive by the surface treatment.

The printing master is prepared by dissolving the photoconductive compound and the binder according to this invention in a solvent (if the photoconductive compound is insoluble, a suspension is prepared by means of a colloid mill, homogenizer, or an ultrasonic dispersion mill), adding thereto a sensitizing dye, then coating the resulting solution or suspension on the support (base material) at a coverage of 1 to 30μ in thickness, and drying the coating layer. An electric charge producing layer and the like may be additionally provided to make laminated printing plates. A suitable solvent is any of the organic solvents which dissolve the binder and dissolve or disperse the photoconductive compound. Examples include alcohols such as methanol, ethanol, propanol, butanol, and hexyl alcohol; "Cellosolves" such as methyl "Cellosolve", ethyl "Cellosolve", and butyl "Cellosolve"; aromatics such as benzene, toluene, and xylenes; cyclic ethers such as dioxane and tetrahydrofuran; esters such as ethyl acetate, butyl acetate, and amyl acetate; ketones such as acetone, methyl isobutyl ketone, and methyl ethyl ketone; dimethylformamide, dimethyl sulfoxide, and halohydrocarbons. A solvent mixture is frequently used in view of solubility, cost, and safety.

Although both the so-called dry toner and the wet toner can be used in forming an image, yet the latter applied by the wet development process is far more desirable because of the excellent definition of the printed image. The toner for use in the printing plate is required to be sufficiently hydrophobic to receive the ink and sufficiently adhesive to the printing plate to withstand the printing operation. Further, it should be resistant to the etching solution containing an alkali and/or an alcohol. As examples of the toners which meet these requirements, mention may be made of styrenic resins, acrylic resins, polyester resins, and epoxy resins. It is desirable from the practical viewpoint that the toner be incorporated with a pigment or dye for the purpose of coloring and a static regulator, so long as these additives have no adverse effect on the stability and the fixation of the toner.

The printing plate according to this invention is prepared by forming a toner image on the printing master and treating the non-image areas with an etching solution containing an alkali and/or an alcohol. Examples of alkalis include sodium hydroxide, potassium hydroxide, sodium carbonate, sodium silicate, sodium phosphate, potassium phosphate, and ammonia. As examples of alcohols, mention may be made of lower alcohols and aromatic alcohols such as methanol, ethanol, propanol, benzyl alcohol, and phenethyl alcohol; ethylene glycol, diethylene glycol, triethylene glycol, polyethylene glycol, and "Cellosolves".

The etching can be performed by an aqueous solution containing an alkali or an alcohol alone. From the viewpoint of etching speed and safety, however, it is preferable to use amino alcohols such as diethanolamine and triethanolamine. Further, regarding the definition and reproducibility of the image, it is most preferable to use a combination of an amino alcohol and an alcohol. After the etching treatment, the printing master is washed with water and with a dilute aqueous acid solution to reduce the scumming and improve the reproducibility of the image in printing.

Example of etching solution.

| | g |
|---|---|
| EDTA-4H | 3 |
| Benzyl alcohol | 30 |
| Monoethanolamine | 10 |
| Triethanolamine | 40 |
| Potassium hydroxide | 20 |
| Water to make up to | 1 liter |

EXAMPLE 1

Preparation of printing master (a) Into a mixture of 500 g of xylene and 200 g of butanol, was dissolved 100 g of the resin example (1) as the binder. To the resulting solution, were added 70 g of 1,3,5-triphenylpyrazoline as the organic photoconductive compound and 70 g of a 1-% Rhodamine B solution in dimethylformamide. To resulting solution was made up with xylene to 1,000 g and coated on a grained sheet of aluminum, 100μ in thickness, at a coverage of 5 g/m$^2$ on solids basis. The coated sheet was dried to obtain a printing master (A)

Reference printing masters (Ref. A) and (Ref. B) were obtained in the same manner as described above, except that reference resin examples (1) and (2), respectively, were used as binders.

(b) Into a mixture of 450 g of xylene and 150 g of butanol, was dissolved 100 g of the resin example (6) as the binder. To the resulting solution, was added 20 g of ε-type copper phthalocyanine as the organic photoconductive compound. The mixture was treated in a ball mill for 2 hours to form a suspension and coated on the same aluminum sheet used above in (a) at a coverage of 5 g/m$^2$ on solids basis. The coated sheet was dried to obtain a printing master (B). Similarly, printing masters (C), (D) and (E) were obtained by using resin examples (7), (11) and (12), respectively, as binders.

A reference printing master (Ref. C) was similarly obtained by using reference resin example (2). A reference printing master (Ref. D) was similarly obtained by using 100 g of a tert-butylphenol-formaldehyde resin.

EXAMPLE 2

(a) The printing master obtained in Example 1 was wound around a cylinder having a radius of curvature of 20 mm intermittently at a rate of once a second to observe the coated surface. As shown in the following table, the printing master containing a binder of brittle physical properties showed a crazing or clouding phenomenon.

(b) A piece of adhesive tape was firmly pressed against the coated surface of the printing master and removed by peeling it off rapidly. The coated surface was observed to evaluate the strength and adhesiveness of the coating film.

| Printing master | (a) | (b) |
|---|---|---|
| A | No change after 10 minutes | o |
| B | " | o |
| C | " | o |
| D | " | Δ-o |
| E | " | o |
| Ref. A | Clouding after about 1 min. | x |
| Ref. B | Crazing after about 1 min. | x |
| Ref. C | " | Δ-x |
| Ref. D | Crazing after about 30 sec. | x |

Note:
o No change after peeling the tape off.
Δ A part of coating film was removed together with the tape.
x Coating film was entirely removed together with the tape.

It was apparent from the test results that a printing master of excellent film strength was obtained by the use of the binder according to this invention.

EXAMPLE 3

The printing master obtained in Example 1 was negatively charged by treating in the dark with 6 kV corona discharge. The master was then exposed to a positive image under white light. The exposed master was immediately developed with a liquid toner (liquid toner MRP of Ricoh Co.) and thermally fixed by means of a fuser. A considerably sharp image was obtained on all printing masters including reference masters. Each master was then immersed in the above-said etching solution. While mildly rubbing the master surface with a sponge, the master surface was observed to measure the time elapsed until the metallic aluminum surface in the non-image areas had been exposed by etching. The printing plate thus obtained was washed with water and tested for the printing endurance by means of Ryobi printer KR2700 using a compounded ink having a tack of 15.

| Printing master | Etching time (second) | Number of copies |
|---|---|---|
| A | 15–20 | Over 20,000 |
| B | 20 | " |
| C | 20 | " |
| D | 20–25 | " |
| E | " | " |
| Ref. A | 45 | 4,000 |
| Ref. B | " | 3,000 |
| Ref. C | 40–45 | " |
| Ref. D | 45–50 | 2,000 |

As is seen from the test results, a reduction in the etching time was observed in the production of a printing plate by the use of a binder according to this invention. Thus, rapid processing became possible. Moreover, the printing endurance was markedly improved and a printing plate of high printing endurance was obtained.

What is claimed is:

1. A method for making a printing plate which comprises forming a toner image by electrophotography on a master plate which comprises a base and an organic photo-conductive compound-containing layer, the binder for said organic photo-conductive compound being an organic solvent soluble half ester resin of a styrene-maleic anhydride copolymer and then subjecting non-image areas other than the toner image areas to an etching treatment with a solution mainly composed of an alkali and/or an alcohol.

2. A method for making a printing plate according to claim 1, wherein the half ester resin has a molecular weight of about 1,000 to about 500,000.

3. A method for making a printing plate according to claim 2, wherein the half ester resin has a molecular weight of 8,000 to 150,000.

4. A method for making a printing plate according to claim 1 wherein alcohols for obtaining the half ester resin are those of 2 to 12 carbon atoms.

5. A method for making a printing plate according to claim 1 wherein toners used for forming the toner image are wet toners.

6. A method for making a printing plate according to claim 1 wherein the etching solution is a combination of an amino alcohol and an alcohol.

7. A printing master plate which comprises a base and an organic photo-conductive compound-containing layer, the binder for said organic photo-conductive compound being a half ester resin of a styrene-maleic anhydride copolymer.

* * * * *